US006059133A

United States Patent [19]

Lai

[11] Patent Number: 6,059,133

[45] Date of Patent: May 9, 2000

[54] CONTAINER CAP PROVIDED WITH IDENTIFICATION MARK

[76] Inventor: Hung-Jen Lai, 369 Ming Chu Road, Changhua, Taiwan

[21] Appl. No.: 09/136,287

[22] Filed: Aug. 19, 1998

[51] Int. Cl.[7] ..... B65D 39/00

[52] U.S. Cl. ..... 215/230; 116/309; 116/316; 116/318; 116/319

[58] Field of Search ..... 215/230; 116/309, 116/316, 318, 319

[56] References Cited

U.S. PATENT DOCUMENTS

| | | | |
|---|---|---|---|
| 1,677,155 | 7/1928 | Swift | 215/230 X |
| 2,817,451 | 12/1957 | Giles et al. | 215/230 |
| 3,073,468 | 1/1963 | Arneson | 215/230 X |
| 3,227,127 | 1/1966 | Gayle | 116/309 X |
| 3,766,882 | 10/1973 | Babbitt, III | 215/230 X |
| 3,960,713 | 6/1976 | Carey | 215/230 X |
| 4,662,520 | 5/1987 | Griffin | 215/230 |
| 4,920,912 | 5/1990 | Kirkling | 116/308 |
| 5,046,605 | 9/1991 | Levrant | 206/5.1 |

*Primary Examiner*—Stephen K. Cronin
*Attorney, Agent, or Firm*—Bacon & Thomas

[57] ABSTRACT

A container cap for a beverage or food container includes a main body having a threaded portion for engagement with a neck of a container, and a rotary disk mounted on the main body by engagement between a protrusion extending from the center of an upper surface of the main body and a slotted retaining member provided at a center of the underside of the rotary disk. The upper surface of the main body is provided with a plurality of marks and at least one window is provided in the rotary disk so that, as the rotary disk is rotated, selected ones of said plurality of marks can be made to appear in said at least one window.

5 Claims, 5 Drawing Sheets

CONTAINER CAP PROVIDED WITH IDENTIFICATION MARK

FIELD OF THE INVENTION

The present invention relates generally to a container cap, and more particularly to a container cap which is provided with identification marks for easy recognition.

BACKGROUND OF THE INVENTION

A leftover beverage or food is often kept for later consumption. The conventional caps of the containers of beverage or food are generally similar in color and shape to one another. As a result, it is often difficult for a person to recognize the container in which the left-over is kept. It is therefore readily apparent that a condition of confusion may arise, especially when there are a number of similar containers. Such an instance often takes place at a picnic or the like.

SUMMARY OF THE INVENTION

The primary objective of the present is therefore to provide a container cap with identification marks enabling a person to recognize the container in which his or her leftover of beverage or food is kept.

The objective, features and functions of the present invention will be more readily understood upon a thoughtful consideration of the following detailed description of the present invention with reference to the accompanying drawings.

DETAILED DESCRIPTION OF THE INVENTION

Figure 1:
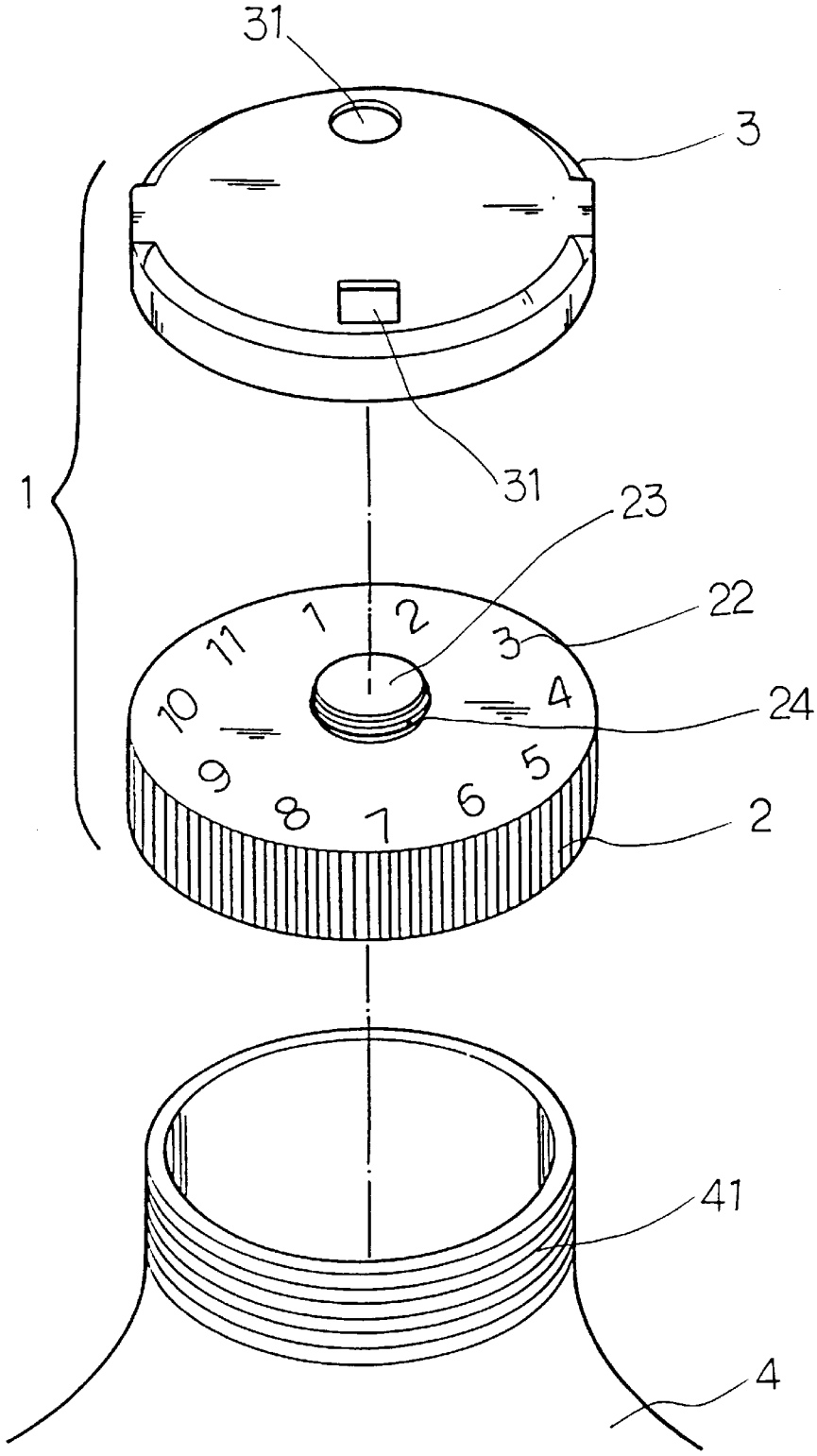
FIG. 1 shows an exploded view of the present invention.
Figure 2:
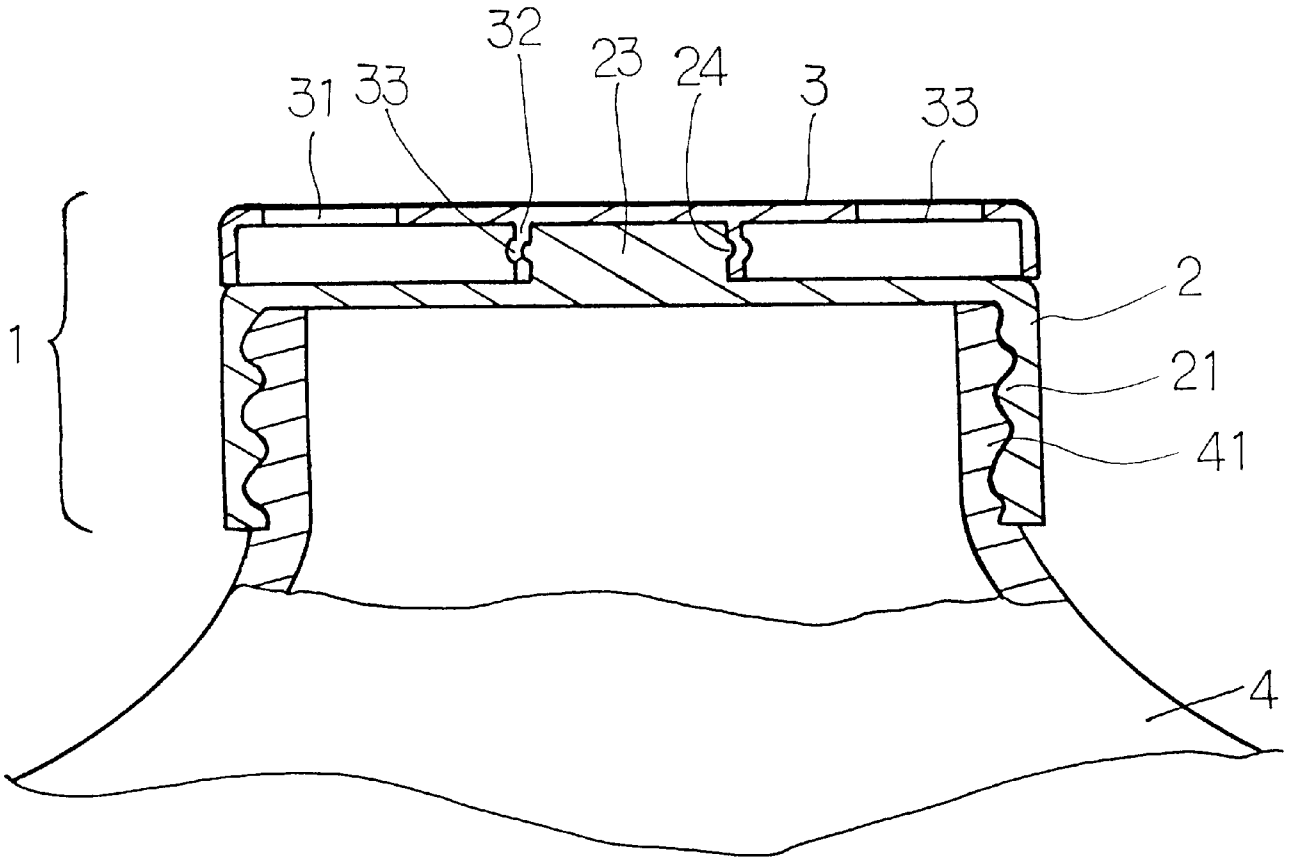
FIG. 2 shows a longitudinal sectional view of the present invention in combination.
Figure 3:
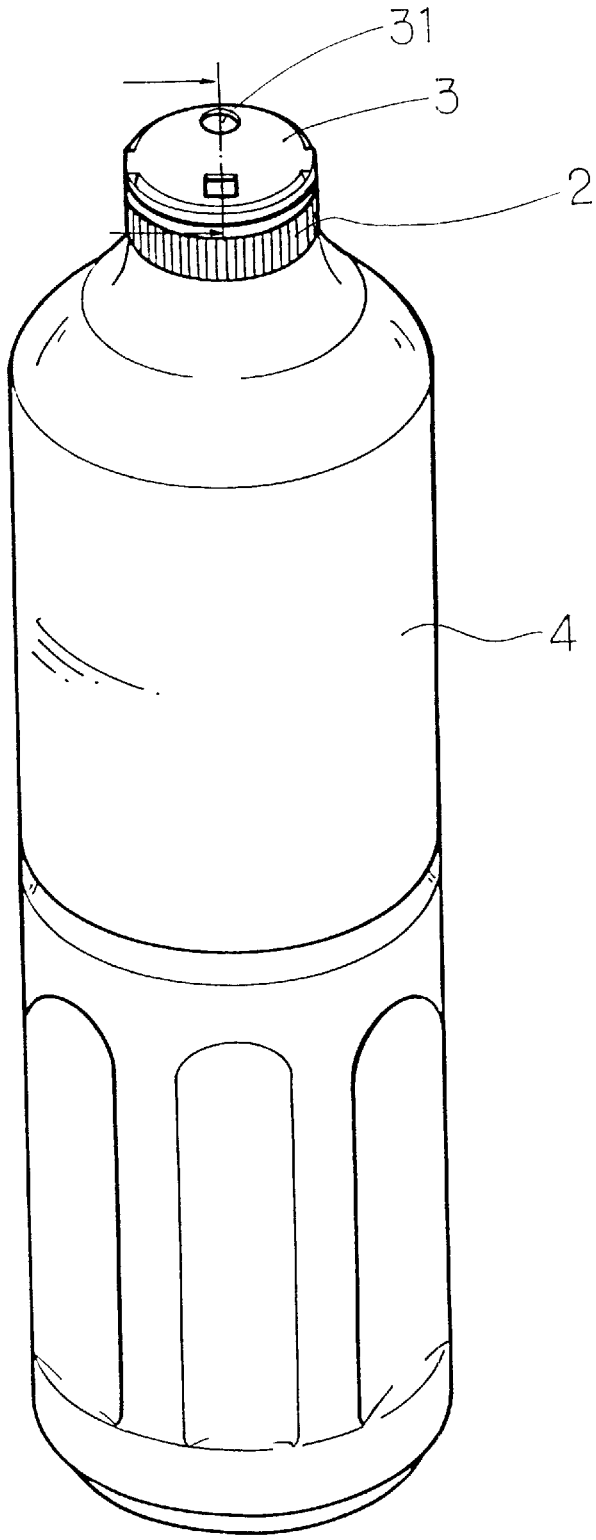
FIG. 3 shows a perspective schematic view of the present invention.

As shown in FIGS. 1–3, a cap 1 embodied in the present invention is composed of a main body 2 and a rotary disk 3. The main body 2 and the rotary disk 3 are made of a metal or plastic material.

The main body 2 is provided in the inner wall thereof with an inner threaded portion 21 which is engaged with an outer threaded portion 41 of the neck of a container 4. The main body 2 is further provided in the upper surface thereof with at least one mark 22, and in the center of the upper surface thereof with a protrusion 23 which is in turn provided in the outer periphery thereof substantially midway between the top and bottom of the protrusion, as shown in FIG. 2, with a retaining portion 24. The protrusion 23 is made integrally with the main body 2.

The rotary disk 3 is provided with at least one window 31 corresponding in location to the mark 22 of the main body 2. The window 31 is of any geometric form, such as round, square, triangular, polygonal, and so forth. The rotary disk 3 is further provided at the center of the underside thereof with a retaining member 32 of a hollow construction and having a retaining slot 33 at a position substantially midway between a top and bottom of the retaining member, as shown in FIG. 2. The retaining member 32 is made integrally with the rotary disk 3.

The rotary disk 3 is rotatably joined with the main body 2 such that the protrusion 23 of the main body 2 is received in the hollow retaining member 32 of the rotary disk 3, and that the retaining portion 24 of the protrusion 23 is retained in the retaining slot 33 of the retaining member 32 of the rotary disk 3.

It must be noted here that the mark 22 may be an Arabic numeral, a letter, a word, a symbol, a figure, etc.

Figure 4:
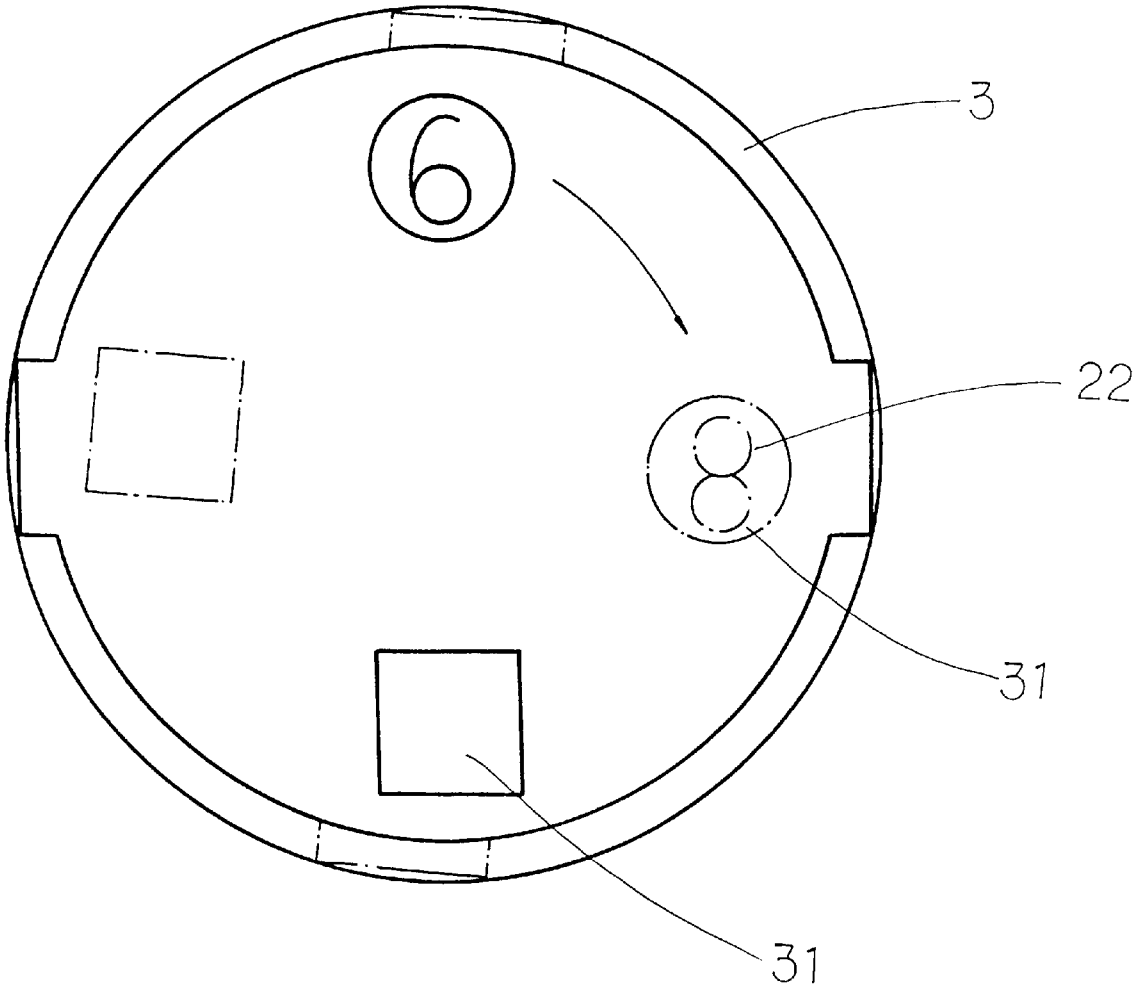
FIG. 4 shows a schematic view of the present invention at work.
Figure 5:
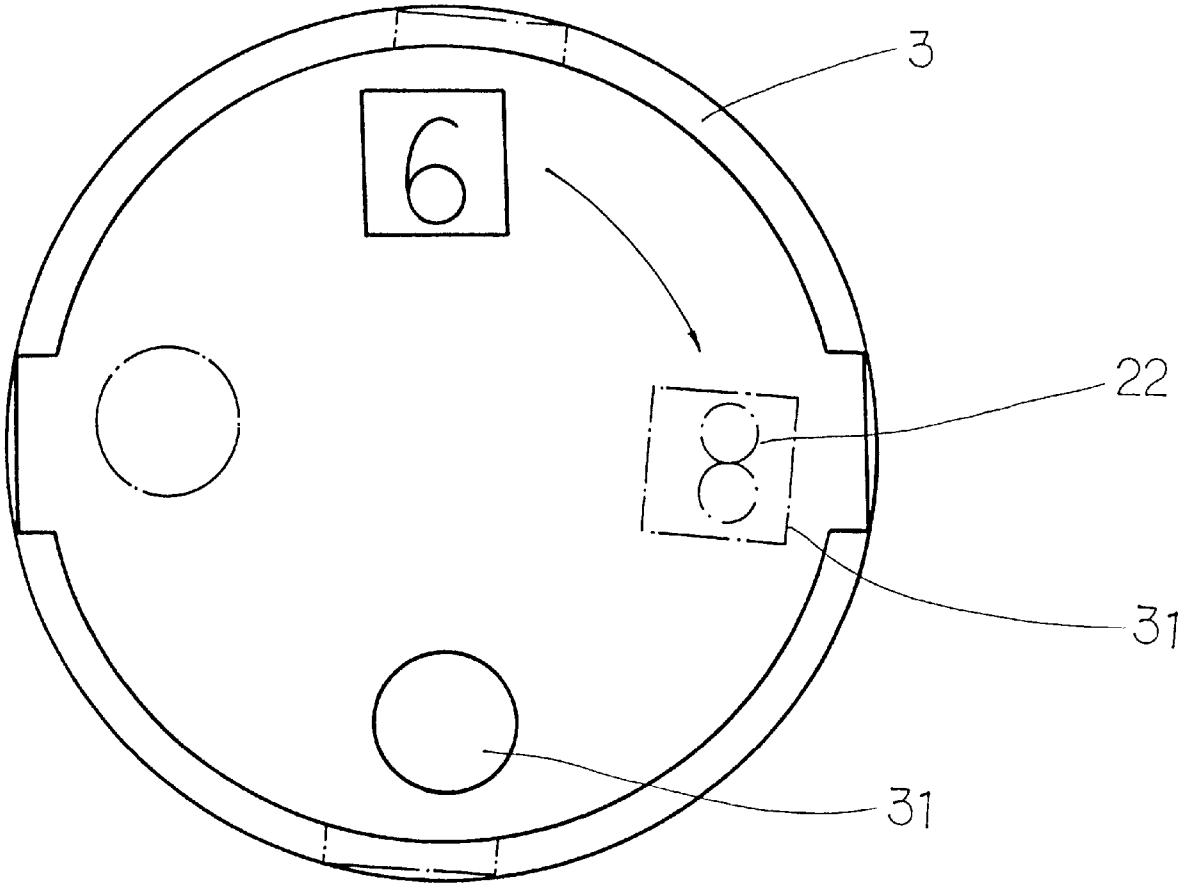
FIG. 5 shows another schematic view of the present invention at work.

As shown in FIG. 4, the rotary disk 3 of the present invention is provided with two marks in the form of Arabic numerals, 6 and 8. The rotary disk 3 is further provided with a round window 31 and a square window 31. After a person has consumed a portion of the beverage or food contained in the container 4, the rotary disk 3 is rotated such that the numeral mark of 8 is seen through the round window 31, as shown by the dotted lines in FIG. 4. The numeral mark of 8 and the round window 31 serve as identification marks to enable the person to recognize the container in which the leftover of his or her beverage or food is kept. The person may prefer the square window 31 to the round window 31, as shown in FIG. 5.

The embodiments of the present invention described above are to be deemed in all respects as being merely illustrative and not restrictive. Accordingly, the present invention may be in other specific forms without deviating from the spirit thereof. The present invention is therefore to be limited only by the scopes of the following appended claims.

What is claimed is:

1. A container cap comprising a main body and a rotary disk rotatably joined with the main body, said main body being provided with an inner threaded portion which is engaged with an outer portion of the neck of a container;

wherein said main body is provided in an upper surface thereof with at least one mark, and in a center of said upper surface with a protrusion having a retaining portion extending radially outwardly from the protrusion substantially midway between a top and a bottom of the protrusion;

wherein said rotary disk is provided with at least one window corresponding in location to said at least one mark of said main body, wherein said rotary disk is further provided at a center of an underside thereof with a retaining member having a hollow construction and a retaining slot extending around said retaining member at a position substantially midway between a top and a bottom of said retaining member, said protrusion being received in said retaining member in order to rotatable join said rotary disk with said main body, and wherein said retaining portion is retained in said retaining slot when protrusion is received in said retaining member to retain said rotary disk on said main body, said at least one window being selectively rotatable to a position at which said at least one mark is visible through said window.

2. The container cap as defined in claim 1, wherein said windows of said rotary disk are round, square, triangular, or polygonal in shape.

3. The container cap as defined in claim 1, wherein said marks of said main body are Arabic numerals, letters, words, symbols, or figures.

4. The container cap as defined in claim 1, wherein said protrusion of said main body is made integrally with said main body.

5. The container cap as defined in claim 1, wherein said retaining member of said rotary disk is made integrally with said rotary disk.

* * * * *